US011512369B2

(12) United States Patent
Lopes et al.

(10) Patent No.: US 11,512,369 B2
(45) Date of Patent: Nov. 29, 2022

(54) METHOD FOR PRODUCING INGOTS CONSISTING OF A METAL COMPOUND CONTAINING TITANIUM

(71) Applicant: SAFRAN AIRCRAFT ENGINES, Paris (FR)

(72) Inventors: Bruno Vitorino Lopes, Moissy-Cramayel (FR); Laurent Ferrer, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 217 days.

(21) Appl. No.: 17/255,277

(22) PCT Filed: Jun. 24, 2019

(86) PCT No.: PCT/FR2019/051541
§ 371 (c)(1),
(2) Date: Dec. 22, 2020

(87) PCT Pub. No.: WO2020/002811
PCT Pub. Date: Jan. 2, 2020

(65) Prior Publication Data

US 2021/0262061 A1 Aug. 26, 2021

(30) Foreign Application Priority Data

Jun. 26, 2018 (FR) ..... 1855713

(51) Int. Cl.
*C22C 1/02* (2006.01)
*C22C 14/00* (2006.01)

(52) U.S. Cl.
CPC ..... *C22C 1/02* (2013.01); *C22C 14/00* (2013.01)

(58) Field of Classification Search
CPC ..... C22C 1/02; C22C 14/00
(Continued)

(56) References Cited

U.S. PATENT DOCUMENTS 2,060,134 A * 11/1936 Summey ..... F27B 17/00 266/212
7,381,366 B2 6/2008 Carter, Jr. et al.

FOREIGN PATENT DOCUMENTS

EA 28477 B1 11/2017
EP 1 845 325 A1 10/2007
(Continued)

OTHER PUBLICATIONS

International Search Report as issued in International Patent Application No. PCT/FR2019/051541, dated Sep. 10, 2019.
(Continued)

*Primary Examiner* — Brian D Walck
(74) *Attorney, Agent, or Firm* — Pillsbury Winthrop Shaw Pittman LLP

(57) ABSTRACT

A method for manufacturing an ingot made of titanium-based metallic compound, includes providing raw material fragments; melting the raw material fragments into a liquid metal in at least one basin; keeping in the molten state the liquid metal in the at least one basin; pouring the liquid metal from the at least one basin into a crucible by overflow from the at least one basin into the crucible; forming an ingot by cooling of the liquid metal into the crucible; wherein the method further includes preheating the raw material fragments before the melting of the raw material fragments with a preheating temperature higher than or equal to 75% of the liquidus temperature of the raw material fragments, and lower less than the liquidus temperature of the raw material fragments.

11 Claims, 2 Drawing Sheets

(58) Field of Classification Search
USPC ..... 148/421
See application file for complete search history.

(56) References Cited

FOREIGN PATENT DOCUMENTS

| | | | |
|---|---|---|---|
| EP | 2 394 756 | A1 | 12/2011 |
| JP | 2007-039807 | A | 2/2007 |
| RU | 2087563 | C1 | 8/1997 |
| RU | 2089633 | C1 | 9/1997 |
| RU | 45734 | U1 | 5/2005 |
| RU | 2311469 | C2 | 11/2007 |
| RU | 2401872 | C2 | 10/2010 |
| RU | 2489506 | C2 | 8/2013 |
| RU | 2606368 | C1 | 1/2017 |
| WO | WO 2009/129570 | A1 | 10/2009 |
| WO | WO 2010/129868 | A1 | 11/2010 |

OTHER PUBLICATIONS

Entrekin, C. H., et al., "Electron Beam Cast Titanium Slab," Proceedings of the 1984 Vacuum Metallurgy Conference on Specialty Metals Melting and Processing, Jan. 1985, XP009177467, pp. 45-48.

Kotani, Y., et al., "Production of Titanium Slab Ingots in a Plasma Electron Beam Furnace," Titanium '80: Science and Technology; Proceedings of the 4$^{th}$ International Conference on Titanium, vol. 3, May 1980, XP009177473, pp. 2147-2215.

Search Report as issued in Russian Patent Application No. 2021101434, dated Dec. 13, 2021.

* cited by examiner

METHOD FOR PRODUCING INGOTS CONSISTING OF A METAL COMPOUND CONTAINING TITANIUM

CROSS-REFERENCE TO RELATED APPLICATIONS

This application is the U.S. National Stage of PCT/FR2019/051541, filed Jun. 24, 2019, which in turn claims priority to French patent application number 1855713 filed Jun. 26, 2018. The content of these applications are incorporated herein by reference in their entireties.

BACKGROUND OF THE INVENTION

The present invention relates to the general field of the manufacture of ingots made of titanium-based metallic compound, such as alloys or intermetallic compounds, in particular for the manufacture of parts for an aircraft.

The ingots made of titanium-based alloy or titanium-based intermetallic compound, are generally manufactured by melting of raw material fragments in different basins, the liquid metal then being poured into a crucible in order to cool and solidify the metal to form the ingots.

However, the method for conventionally manufacturing the titanium ingots can lead to a problem of reduction of the mechanical properties of the obtained ingot relative to the desired mechanical properties.

OBJECT AND SUMMARY OF THE INVENTION

The main aim of the present invention is therefore to overcome such a drawback by proposing, according to a first aspect of the invention, a method for manufacturing an ingot made of titanium-based metallic compound comprising the following steps:

- providing raw material fragments;
- melting the raw material fragments into a liquid metal in at least one basin;
- keeping in the molten state the liquid metal in said at least one basin;
- pouring the liquid metal from the at least one basin into a crucible by overflow from said at least one basin into said crucible;
- forming an ingot by cooling of the liquid metal in the crucible;

characterized in that the method comprises the following step:

- preheating the raw material fragments before the melting of said raw material fragments with a preheating temperature higher than or equal to 75% of the liquidus temperature of said raw material fragments, said preheating temperature being strictly lower than the liquidus temperature.

Such a step of preheating the raw material fragments allows improving the homogeneity of the metal in the basin, in particular by reduction of the presence of unmelted material in the basin.

In addition, such preheating allows reducing the temperature decrease in the basin when the newly melted metal falls in said basin, thus also improving the homogeneity by facilitating the dissolution of the unmelted materials in the basin, and increasing the melting rate of the metallic compound allowing productive gains.

In addition, such preheating allows reducing the thermal shock experienced by the raw materials during the melting step, thus reducing the off-gases of the raw materials. These off-gases can cause reactions which are likely to create inclusions, these inclusions reducing the mechanical properties of the ingots. The reactions caused by the off-gases can also produce elements which are deposited at the crucible, thus reducing the mechanical properties of the ingots. In addition, the thermal shock of the raw materials favors the projections of small solid particles of raw material which can fall further downstream in the basin and thus have a short duration for it to be dissolved, thus increasing the risk for unmelted particles to remain in the crucible and decrease the mechanical properties of the ingots.

Such a preheating step is particularly advantageous for the manufacture of ingots made of titanium-based metallic compound because these metallic compounds have a high melting temperature (titanium having a melting temperature of 1,668° C.), the titanium-based metallic compounds having a higher risk of presence of unmelted metal particles during the formation of the ingot.

The method may comprise the following characteristics, taken alone or in combination depending on the technical possibilities:

- the preheating temperature is higher than or equal to the solidus temperature of the raw material fragments;
- the preheating temperature is higher than or equal to 93% of the liquidus temperature;
- the titanium-based metallic compound comprises at least one element having a melting temperature higher than the melting temperature of the titanium;
- the preheating of the raw material fragments is carried out by induction;
- the induction-preheating of the raw material fragments is configured to ensure levitation of said raw material fragments;
- the preheating of the raw material fragments is carried out by a generator of a heating beam;
- the method comprises a step of controlling the orientation of the generator of the heating beam;
- the method comprises the following steps:
- melting the raw material fragments into a liquid metal in a first basin;
- keeping in the molten state the liquid metal in the first basin;
- pouring the liquid metal from the first basin in a second basin by overflow from said first basin in said second basin;
- keeping in the molten state the liquid metal in the second basin;
- pouring the liquid metal from the second basin into the crucible by overflow from said second basin into said crucible.

According to a second aspect, the invention proposes a system for manufacturing an ingot made of titanium-based metallic compound comprising:

- at least one basin which is configured to receive liquid metal;
- a conveyor which is configured to convey raw material fragments to said at least one basin;
- a crucible which is fed by overflow from said at least one basin and which is configured to cool and solidify the liquid metal;
- heating means which are located opposite the at least one basin and the crucible and which are configured to heat and melt raw material fragments in said at least one basin and in said crucible;

characterized in that the system comprises a preheating device which is configured to heat on the conveyor the raw material fragments with a preheating temperature higher than or equal to 75% of the liquidus temperature of said raw material fragments, and strictly lower than the liquidus temperature of said raw material fragments.

The system can comprise the following characteristics, taken alone or in combination depending on the technical possibilities:

- the preheating device comprises a generator of a heating beam;
- the system comprises an image acquisition device and an image analysis device, said image acquisition device being configured to acquire images of the preheating of the raw material fragments by the generator of the heating beam, and said image analysis device being configured to control the orientation of the generator of the heating beam from the images acquired by said image acquisition device;
- the preheating device comprises an induction-preheating device;
- the induction-preheating device is configured to ensure levitation of the raw material fragments.

BRIEF DESCRIPTION OF THE DRAWINGS

Other characteristics and advantages of the present invention will emerge from the description given below, with reference to the appended drawings which illustrate an exemplary embodiment thereof without any limitation. In the figures.

DETAILED DESCRIPTION OF THE INVENTION

Figure 1:
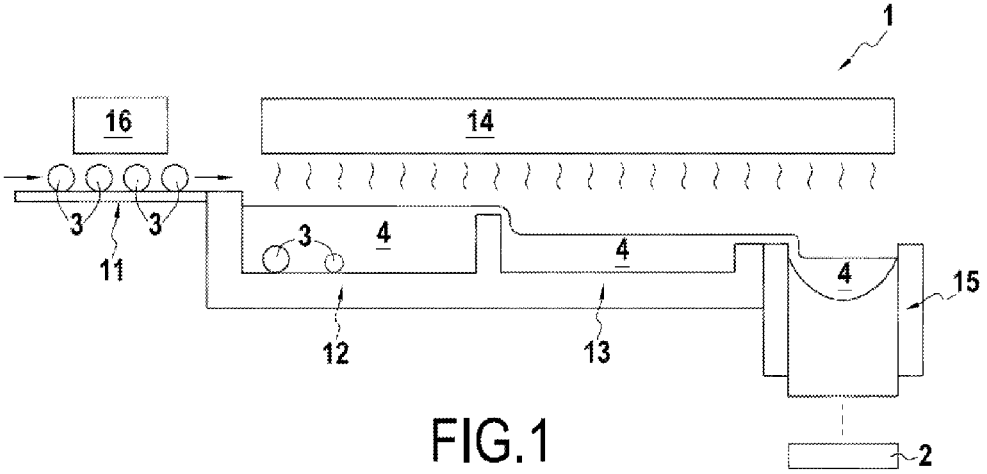
FIG. 1 schematically represents a system for manufacturing an ingot made of titanium-based metallic compound according to one embodiment of the invention.

As illustrated in FIG. 1, a system 1 for manufacturing an ingot 2 made of titanium-based metallic compound comprises a conveyor 11 on which raw material fragments 3 are conveyed. The conveyor 11 may for example be formed by a vibrating table, a push cylinder, a conveyor belt or a worm screw.

The raw material fragments 3 can be master alloys, recycled material fragments or virgin raw material of titanium-based alloy or titanium-based intermetallic compound. Typically, the raw material fragments 3 can be formed by blocks of particles, such as chips, which are press agglomerated and compacted, these blocks having a length comprised between 20 cm and 50 cm for example.

By titanium-based metallic compound is understood here either a titanium-based alloy, that is to say an alloy whose titanium is the main constituent, or a titanium-based intermetallic compound, that is to say an intermetallic compound whose titanium is the main constituent. An alloy is a combination of different metals, while an intermetallic compound is a combination of at least one metal with at least one metalloid.

The metallic compound can for example be an alloy from among the following alloys: Ti17, TiBeta16, Ti21S, Ti6242 and Ti6246; or an intermetallic compound from among the following intermetallic compounds: TiAl 48-2-2 and TiNMB1. The examples given are not limiting, other alloys or titanium-based intermetallic compounds can be used.

The system 1 comprises at least one basin in which the raw material fragments 3 are melted. In the exemplary embodiment illustrated in FIG. 1, the system 1 comprises a first basin 12 and a second basin 13 located downstream of said first basin 12. The number of basins can however be greater, the system 1 thus being able to comprise three or four basins for example, or smaller, the system 1 thus being able to comprise a single basin.

The first basin 12 and the second basin 13 collect liquid metal 4 obtained by the melting of the raw material fragments 3.

The first basin 12 and the second basin 13 are formed on the one hand by a wall which receives the liquid metal 4, said wall being for example made of copper, and on the other hand by a cooling device which allows keeping the wall at a temperature below its deterioration temperature, said cooling device being typically produced by a coolant circulation circuit.

The raw material fragments 3 are melted in the first basin 12, then the liquid metal 4 obtained by the melting of said raw material fragments 3 is transferred to the second basin 13.

The melting of the raw material fragments 3 is carried out by heating means 14 which are located opposite the first basin 12 and the second basin 13.

The heating means 14 can for example be formed by plasma torches, electron guns, electric arc generators, laser generators or induction-heating means.

In addition, the heating means 14 are configured to keep in the molten state the liquid metal 4 in the first and second basins 12 and 13 in order to place the liquid metal 4 in the desired metallurgical condition.

The atmosphere in which the first basin 12 and the second basin 13 are located can be controlled. In order for the liquid metal 4 not to react with the atmosphere, the controlled atmosphere can, for example, be achieved by a vacuum atmosphere or by an inert gas atmosphere under controlled pressure. According to another possible variant, the controlled atmosphere is formed by a specific gas under a controlled pressure, said specific gas being adapted to react with the liquid metal 4 in order to charge said liquid metal 4, and thus the metallic compound of the ingot 2, with said specific gas.

The first basin 12 and the second basin 13 can also be exposed to an uncontrolled atmosphere.

As illustrated in FIG. 1, the system 1 comprises a crucible 15 into which the liquid metal 4 of the second basin 13 is poured in order to cool said liquid metal 4, solidify it and thus form a solid metal advancing front 5 which is shaped to form the ingot 2 by semi-continuous casting.

In order to cool the liquid metal 4 which is poured into the crucible 15, said crucible 15 comprises a cooling circuit which cools the walls of said crucible 15. The walls of the crucible 15, which are cooled by the cooling circuit, are made of high-thermal conductivity material, for example of copper or copper alloy.

Moreover, as can be seen in FIG. 1, the heating means 14 are also located opposite the crucible 15 and are configured to keep in the molten state the liquid metal 4 in the upper portion of the crucible 15. The liquid metal 4 is transferred from the first basin 12 to the second basin 13 and from the second basin 13 to the crucible 15 by overflow. In other words, the second basin 13 is fed by overflow of the liquid metal 4 from the first basin 12 to said second basin, and the crucible 15 is fed by overflow of the liquid metal 4 from the second basin 13 to said crucible 15. Such a characteristic allows limiting the risk for an unmelted metal particle to reach the crucible 15, which would reduce the mechanical properties of the ingot 2. Indeed, the still solid metal tends to fall to the bottom of the first basin 13 and of the second basin 14. In order to improve the mechanical characteristics of the ingot 2 of the titanium-based metallic compound, the system 1 comprises a preheating device 16 which is located opposite the conveyor 11 and which is configured to preheat the raw material fragments 3 before said raw material fragments 3 are melted in the first basin 12.

The preheating device 16 is configured to heat the raw material fragments 3 at a preheating temperature which is higher than or equal to 75% of the liquidus temperature of said raw material fragments 3, and which is strictly lower than the liquidus temperature of said raw material fragments 3.

Such a preheating temperature allows decreasing the temperature gradient at the inlet of the first basin 12. This allows facilitating the melting of the raw material fragments 3, which reduces the presence of unmelted metal particles in the first and second basins 12 and 13, thus limiting the risk for these unmelted metal particles to reach the crucible 15.

The preheating according to the invention allows in particular reducing the presence of the small-sized unmelted metal particles by facilitating the melting of these particles, the small-sized particles being the most likely not to fall to the bottom of the first and second basins 12 and 13 and therefore to be poured with the liquid metal 4 into the crucible 15.

In addition, such a preheating temperature allows reducing the thermal shock experienced by the raw material fragments 3 when they arrive in the first basin 12. The reduction of the thermal shock allows reducing the off-gases, thus limiting the reactions caused by these off-gases which are likely to produce unwanted elements in the metallic compound degrading the mechanical properties of the ingot.

Preferably, the preheating temperature is higher than or equal to the solidus temperature of the metallic compound, which allows further accelerating the dissolution of the solid metal particles in the first and second basins 12 and 13, and allows reducing the thermal shock. The preheating temperature is always strictly lower than the liquidus temperature of the alloy.

Thus, the raw material fragments 3 are partially melted because they are at a temperature higher than the solidus temperature but strictly lower than the liquidus temperature of the metallic compound.

Even more preferably, the preheating temperature is higher than or equal to 93% of the liquidus temperature of the alloy, making it possible to further accelerate the dissolution of the solid metal particles, and to further reduce the temperature difference experienced by the raw material fragments 3. Here again, the preheating temperature is strictly lower than the liquidus temperature of the alloy.

The invention is particularly advantageous for the titanium-based metallic compounds which comprise elements having a melting temperature higher than the melting temperature of the titanium such as, for example, molybdenum, vanadium or tantalum. Indeed, the elements present in the metallic compound which have a melting temperature higher than the melting temperature of the titanium, such as for example molybdenum, vanadium and tantalum, are elements which tend to form unmelted particles in the liquid metal 4 which can reach the crucible 15.

Figure 2:
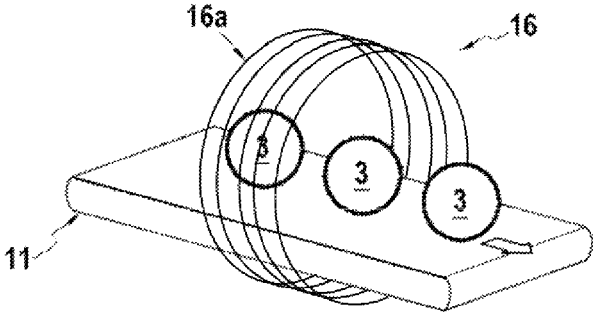
FIG. 2 represents a first variant of a preheating device of the ingot manufacturing system.

According to a first possible variant illustrated in FIG. 2, the preheating device 16 comprises an induction-preheating device 16*a*. The induction-preheating device 16*a* can be formed by a solenoid as illustrated in FIG. 2, or by an induction plate parallel to the conveyor 11.

According to an advantageous characteristic making it possible to limit the pollution of the raw material fragments 3 by contact with the conveyor 11, the induction-preheating device 16*a* is configured to ensure levitation of said raw material fragments 3 above the conveyor 11.

The configuration of the induction-preheating device 16*a* to ensure the gradual rise in temperature and the levitation of the raw material fragments are achieved by adapting the intensity and the frequency of the electric current passing through said induction-preheating device 16*a*.

Figure 3:
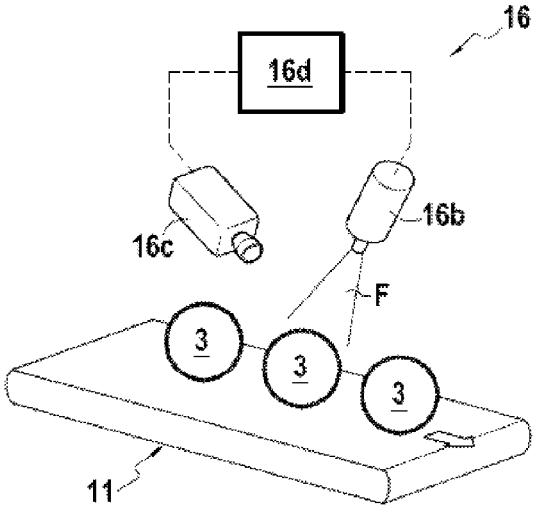
FIG. 3 represents a second embodiment of the preheating device.

According to a second variant illustrated in FIG. 3, the preheating device 16 comprises a generator 16*b* of a heating beam F, such as for example a light source, an electron-beam generator, a plasma torch or a laser generator.

Advantageously, in order to improve the efficiency of preheating of the raw material fragments 3, the preheating device comprises an image acquisition device 16*c*, such as for example a camera, and an image analysis device 16*d*, such as for example a processor and a memory on which an image processing program is recorded. The image acquisition device 16*c* is configured to acquire images of the preheating of the raw material fragments 3 by the generator 16*b* of the heating beam F.

The image acquisition device 16*c* is also configured to transmit the acquired images to the image analysis device 16*d*. The image analysis device 16*d* is for its part configured to analyze the images transmitted by the image acquisition device 16*c* and to control the orientation of the generator 16*b* of the heating beam F by checking that the heating beam F is indeed directed towards the raw material fragments 3, and not directed next to said raw material fragments 3, directly towards the conveyor 11.

When the image analysis device 16*d* detects that the heating beam F is not directed correctly, said image analysis device 16*d* can issue an alert so that an operator or an automaton corrects the orientation of the generator 16*b* of the heating beam F. The image analysis device 16*d* can also be configured to control the orientation of the generator 16*b* of the heating beam F so that when said image analysis device 16*d* detects that the heating beam F is not directed correctly, said image analysis device 16*d* automatically corrects the orientation of said generator 16*b* of the heating beam F.

Figure 4:
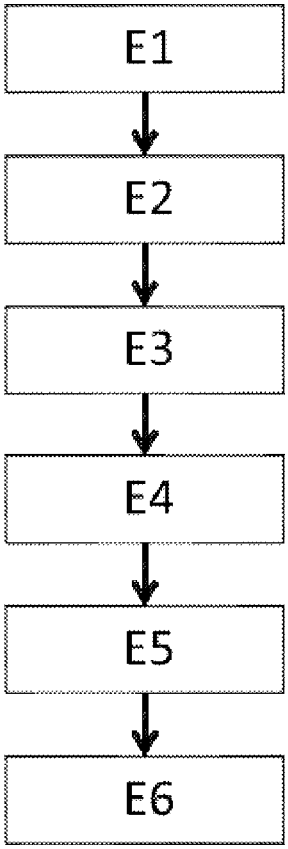
FIG. 4 represents a schematic view of the different steps of a method for manufacturing an ingot made of titanium-based metallic compound according to one implementation of the invention.

The system 1 for manufacturing the ingot 2 made of titanium-based metallic compound is configured to implement the manufacturing method illustrated in FIG. 4.

As illustrated in FIG. 4, the method for manufacturing the ingot 2 comprises the following steps:

- E1: providing the raw material fragments 3. This step E1 is carried out with the conveyor 11.
- E2: preheating the raw material fragments 3 with a preheating temperature higher than or equal to 75% of the liquidus temperature of said raw material fragments 3, and strictly lower than the liquidus temperature of said raw material fragments 3. This preheating step E2 is carried out with the preheating device 16.
- E3: melting the raw material fragments 3 into a liquid metal 4 in at least one basin. This melting step is carried out after the preheating step E2. This melting step E3 is carried out with the heating means 14.

E4: keeping in the molten state the liquid metal 4 in said at least one basin. This step of keeping in the molten state allows placing the liquid metal 4 in the desired metallurgical state, and in addition allows ensuring good dissolution of the unmelted metal particles. This step E4 of keeping in the molten state is carried out with the heating means 14.

E5: pouring the liquid metal 4 from the at least one basin into the crucible 15 by overflow from said at least one basin into said crucible 15.

E6: forming the ingot 2 by cooling of the liquid metal 4 in the crucible 15.

Figure 5:
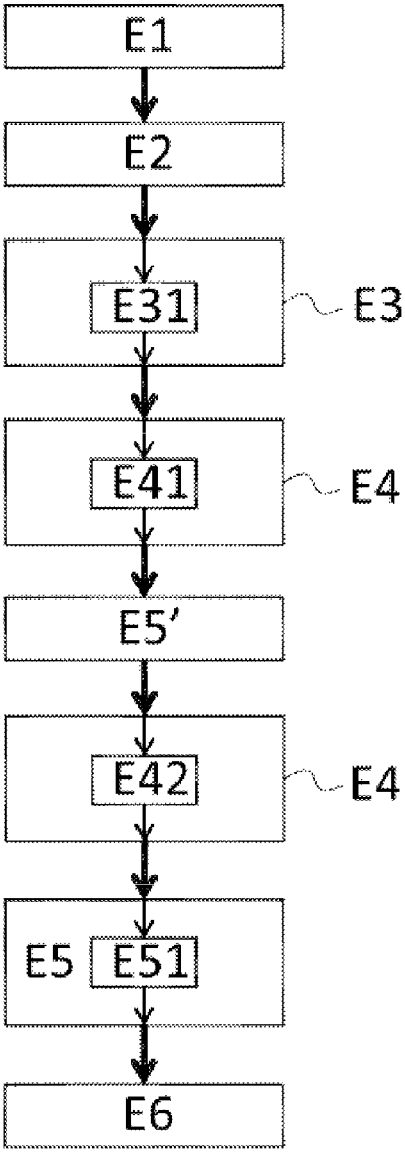
FIG. 5 represents a schematic view of the different steps of the manufacturing method implemented with the variant of the manufacturing system of FIG. 1.

With the embodiment of the system 1 illustrated in FIG. 1, the method comprises the following steps, as illustrated in FIG. 5:

E31: melting the raw material fragments 3 into a liquid metal 4 in the first basin 12. This step E31 of melting in the first basin 12 is a variant of the step E3 of melting in at least one basin.

E41: keeping in the molten state the liquid metal 4 in the first basin 12. This step E41 of keeping in the molten state in the first basin 12 is a variant of the step E4 of keeping in the molten state in at least one basin.

E5': pouring the liquid metal 4 from the first basin 12 in the second basin 13 by overflow from said first basin 12 in said second basin 13.

E42: keeping in the molten state the liquid metal 4 in the second basin 13. This step E42 of keeping in the molten state in the second basin 13 is a variant of the step E4 of keeping in the molten state in at least one basin.

E51: pouring the liquid metal 4 from the second basin 13 into the crucible 15 by overflow from said second basin 13 into said crucible 15. This step E51 of pouring into the crucible 15 by overflow from the second basin 13 is a variant of the step E5 of pouring into the crucible 15 by overflow from at least one basin.

Furthermore, when the preheating of the raw material fragments 3 is carried out with a generator 16*b* of a heating beam F, the method for manufacturing the ingot 2 made of titanium-based metallic compound can comprise a step of controlling the orientation of the heating beam F carried out during the step E2 of preheating the raw material fragments 3. This step of controlling the orientation of the heating beam F is carried out by the image analysis device 16*d* from the images acquired by the image acquisition device 16*c*.

The invention claimed is:

1. A method for manufacturing an ingot (2) made of titanium-based metallic compound comprising:

providing raw material fragments;

melting the raw material fragments into a liquid metal in at least one basin;

keeping in the molten state the liquid metal in said at least one basin;

pouring the liquid metal from the at least one basin into a crucible by overflow from said at least one basin into said crucible;

forming an ingot by cooling of the liquid metal into the crucible;

wherein the method further comprises:

preheating the raw material fragments before the melting of said raw material fragments with a preheating temperature higher than or equal to 75% of the liquidus temperature of said raw material fragments and strictly lower than the liquidus temperature of said raw material fragments.

2. The method according to claim 1, wherein the preheating temperature is higher than or equal to the solidus temperature of the raw material fragments.

3. The method according to claim 2, wherein the preheating temperature is higher than or equal to 93% of the liquidus temperature.

4. The method according to any claim 1, wherein the titanium-based metallic compound comprises at least one element having a melting temperature higher than the melting temperature of the titanium.

5. The method according to any claim 1, wherein the preheating of the raw material fragments (3) is carried out by induction.

6. The method according to any one of claim 1, wherein the preheating of the raw material fragments is carried out by a generator of a heating beam.

7. The method according to claim 6, wherein said method further comprises controlling the orientation of the generator of the heating beam.

8. The method according to claim l, wherein the method further comprises:

melting the raw material fragments into a liquid metal in a first basin;

keeping in the molten state the liquid metal in the first basin;

pouring the liquid metal from the first basin in a second basin by overflow from said first basin in said second basin;

keeping in the molten state the liquid metal in the second basin;

pouring the liquid metal from the second basin into the crucible by overflow from said second basin into said crucible.

9. A system (1) for manufacturing an ingot made of titanium-based metallic compound comprising:

at least one basin which is configured to receive the liquid metal;

a conveyor which is configured to convey raw material fragments to said at least one basin;

a crucible which is fed by overflow from said at least one basin and which is configured to cool and solidify the liquid metal;

a heating system located opposite the at least one basin and the crucible and configured to melt and keep in the molten state raw material fragments in said at least one basin and in said crucible;

wherein the system comprises a preheating device which is configured to heat on the conveyor said raw material fragments with a preheating temperature higher than or equal to 75% of the liquidus temperature of said raw material fragments and strictly lower than the liquidus temperature of said raw material fragments.

10. The system according to claim 9, wherein the preheating device comprises a generator of a heating beam.

11. The system according to claim 9, wherein the preheating device comprises an induction-preheating device.

* * * * *